US005232812A

United States Patent [19]

Morrison et al.

[11] Patent Number: 5,232,812

[45] Date of Patent: Aug. 3, 1993

[54] METHOD OF FORMING IMAGES USING CURABLE LIQUID

[75] Inventors: Ian D. Morrison, Webster; Christine J. Tarnawskyj, Rochester; Bing R. Hsieh; Paul W. Morehouse, Jr., both of Webster, all of N.Y.

[73] Assignee: Xerox Corporation, Stamford, Conn.

[21] Appl. No.: 946,696

[22] Filed: Sep. 18, 1992

[51] Int. Cl.[5] ..... G03G 13/22

[52] U.S. Cl. ..... 430/124; 430/42; 430/97; 430/126

[58] Field of Search ..... 430/42, 97, 124, 126

[56] References Cited

U.S. PATENT DOCUMENTS

| | | | |
|---|---|---|---|
| 3,819,368 | 6/1974 | Luebbe et al. | 430/124 X |
| 3,861,911 | 1/1975 | Luebbe | 430/124 X |
| 3,989,609 | 11/1976 | Brack | 427/44 |
| 4,092,173 | 5/1978 | Novak et al. | 427/44 |
| 4,426,431 | 1/1984 | Harasta et al. | 430/14 |
| 4,477,548 | 10/1984 | Harasta et al. | 430/14 |
| 4,954,364 | 9/1990 | Stein et al. | 427/54.1 |

FOREIGN PATENT DOCUMENTS

| | | | |
|---|---|---|---|
| 252559 | 11/1986 | Japan | 430/97 |

OTHER PUBLICATIONS

Moser, "Method to Improve Color Copy and Transparency Quality", Xerox Discl. Jour., vol. 16, No. 5, Sep.-/Oct. 1991, p. 333.

*Primary Examiner*—Roland Martin
*Attorney, Agent, or Firm*—Judith L. Byorick

[57] ABSTRACT

Disclosed is a process for forming images which comprises generating an electrostatic image on an imaging member, developing the electrostatic image with a toner, optionally transferring the developed toner image from the imaging member to a substrate, applying to the developed toner image a curable liquid in which the toner is at least partially soluble, and curing the liquid to a solid.

17 Claims, No Drawings

METHOD OF FORMING IMAGES USING CURABLE LIQUID

BACKGROUND OF THE INVENTION

The present invention is directed to a process for forming images with toners. More specifically, the present invention is directed to a process wherein toner images are coated with a curable liquid in which the toner is at least partially soluble, followed by curing the image to a solid. One embodiment of the present invention is directed to a process for forming images which comprises generating an electrostatic image on an imaging member, developing the electrostatic image with a toner, optionally transferring the developed toner image from the imaging member to a substrate, applying to the developed toner image a curable liquid in which the toner is at least partially soluble, and curing the image to a solid.

The formation and development of images on the surface of photoconductive materials by electrostatic means is well known. For example, U.S. Pat. No. 2,297,691 discloses an electrophotographic imaging process that entails placing a uniform electrostatic charge on a photoconductive insulating layer, such as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. When the toner is charged to a polarity opposite to that of the latent electrostatic image on the photoreceptor, the toner will normally be attracted to those areas of the photoreceptor which retain a charge, thereby forming a toner image corresponding to the electrostatic latent image. When the toner is charged to the same polarity as that of the charge applied to the photoreceptor, the toner will normally be attracted to those areas which have been discharged; this process is known as discharge area development. This developed image may then be transferred to a substrate such as paper and subsequently be permanently affixed to the substrate.

In ionographic imaging processes, a latent image is formed on a dielectric image receptor or electroreceptor by ion deposition, as described, for example, in U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, and 4,155,093, the disclosures of each of which are totally incorporated herein by reference. Generally, the process entails application of charge in an image pattern with an ionographic writing head to a dielectric receiver that retains the charged image. The image is subsequently developed with a developer capable of developing charge images.

Processes entailing the overcoating of images are known. For example, U.S. Pat. No. 4,477,548 (Harasta et al.), the disclosure of which is totally incorporated herein by reference, discloses curable coating compositions useful for protective treatments of elements bearing electrographically formed toner images which comprise (a) either (i) a mixture of a siloxy-containing polycarbinol and an acrylated urethane, or (ii) a siloxy-containing acrylated urethane, (b) a multifunctional acrylate, and, optionally, (c) a free radical photoinitiator. Toner image bearing elements, such as electrographic elements and specifically photoconductive recording films, can be provided with a protective overcoat layer which is bonded to the element and which serves to protect the toner image from abrasion and scratches. Such an overcoat layer is provided by coating the element with a curable composition and curing the resulting coating. The protective overcoat layer is applied to the toner image-bearing side of the element.

U.S. Pat. No. 4,426,431 (Harasta et al.), the disclosure of which is totally incorporated herein by reference, discloses radiation-curable compositions useful for restorative and/or protective treatment of photographic elements which comprise a polymerizable epoxy compound, a cationic initiator for initiating polymerization of the epoxy compound, a polymerizable acrylic compound, a haloalkylated aromatic ketone which serves as a free-radical intitiator for initiating polymerization of the acrylic compound, and a polymerizable organofunctional silane. Photographic elements, such as still films, motion picture films, paper prints, microfiche, and the like are provided with a protective overcoat layer which is permanently bonded to the element and serves to protect it from abrasion and scratches by coating the element with the radiation-curable composition and irradiating the coating to bond it to the element and cure it to form a transparent, flexible, scratch-resistant, crosslinked polymeric layer. The protective overcoat layer can be applied to the image bearing side of the element or to the support side of the element or to both sides. The radiation-curable composition can also be used as a restorative composition in the treatment of photographic elements which have scratches, abrasion marks, or the like which impair the appearance or projection capabilities of the element. In use as a restorative composition, the radiation-curable composition can be applied locally in the region of the defects only, to eliminate them effectively and restore the element to a substantially defect-free condition, or it can be applied over the entire surface of the element to both eliminate the defects and form a protective overcoat layer that is capable of providing protection against subsequent scratching or abrasion.

U.S. Pat. No. 4,092,173 (Novak et al.), the disclosure of which is totally incorporated herein by reference, discloses photographic elements, such as still films, motion picture films, paper prints, microfiche, or the like, which are provided with a protective overcoat layer which is permanently bonded to the element and serves to protect it from abrasion and scratches. The protective overcoat is formed by coating the element with a radiation-curable composition comprising an acrylated urethane, an aliphatic ethylenically-unsaturated carboxylic acid, and a multifunctional acrylate, and irradiating the coating to bond it to the element and cure it to form a transparent, flexible, scratch-resistant, crosslinked polymeric layer. Protective overcoat layers can be applied to the image-bearing side of the element or to the support side of the element or to both sides.

U.S. Pat. No. 4,954,364 (Stein et al.), the disclosure of which is totally incorporated herein by reference, discloses a method for enhancing the controlled release characteristics of paper or plastic substrates by applying onto the substrate a UV curable mixture of an epoxysilicone, an arylonium salt catalyst, such as diaryliodoniumhexafluoroantimonate, and a controlled release additive such as a phenolpropyl-substituted methyldisiloxane or an alkylphenol, such as dodecylphenol. The treated plastic or paper substrate is then subjected to UV irradiation to effect a tack-free cure of the UV curable mixture on the substrate.

U.S. Pat. No. 3,989,609 (Brack), the disclosure of which is totally incorporated herein by reference, discloses a prepolymer containing unsaturated hydrocarbon groups prepared and mixed on a roller mill with one or more acrylic ester monomers and various additives to make a coating formulation of a desired viscosity. In general, low viscosity formulations are used for overprint varnishes, on paper or foil, or with pigments, for certain types of printing inks. Higher viscosity formulations are used to apply thick films on panels, tiles or other bodies. Thin films are cured to hardness by brief exposure to ultraviolet light. Thicker films require more energetic radiation such as plasma arc and electron beam radiation. The prepolymers particularly useful for making such radiation curable coatings are the reaction products of polyether polyols and bis- or polyisocyanates and hydroxy alkenes or acrylic (or methacrylic) hydroxy esters, and, likewise, reactive polyamides modified with dicarboxy alkenes, their anhydrides, or esters. A small amount of wax incorporated in the coating formulations results in coatings with release characteristics similar to those of PTFE coatings.

Although known compositions and processes are suitable for their intended purposes, a need remains for processes for permanently affixing toned images to a variety of substrates, both porous and nonporous, and to substrates with a wide range of thermal conductivity, ductility, and thickness. In addition, a need remains for processes for permanently affixing toned images to substrates that enable improved color quality. It is believed that the process of the present invention, wherein the toner pile comprising the image is at least slightly dissolved in the overcoating material, spurious light scattering is decreased, thereby improving color quality. Further, there is a need for processes for permanently affixing toned images to substrates that minimize or eliminate the conventional high energy fusing step in the imaging process, such as the application of heat, pressure, or combinations thereof. The process of the present invention, wherein the overcoated toner pile comprising the image is cured to a solid, requires substantially less energy, thus reducing both the electrical power requirements and the ambient temperatures during development. Additionally, there is a need for processes for permanently affixing toned images to substrates that enable improved smoothness of the imaged substrate's surface. It is believed that the process of the present invention, wherein the toner image is overcoated with a curable material, improves surface smoothness, thereby improving image quality, particularly for color images and transparencies. Further, there is a need for processes for permanently affixing toned images to substrates that enable production of high quality transparencies with monochrome black or colored images thereon. Additionally, there is a need for processes for permanently affixing toned images to substrates that enable production of high quality transparencies with multi-colored images thereon. Further, typical electroscopic toners are fixed by heating on the substrate, which requires toner materials that melt easily (to lessen power requirements) but which don't conhere in machine ambient conditions. The process of the present invention enables the use of toners which can be at least partially soluble in the overcoating but which need not melt easily. The process of the present invention also enables the use of toners which melt at low temperatures, since the cured overcoating which is formed in the process prevents these toners from blocking or sticking to adjacent sheets in a stack.

SUMMARY OF THE INVENTION

It is an object of the present invention to provide processes for permanently affixing toned images to substrates with at least some of the aforementioned advantages.

It is another object of the present invention to provide processes for permanently affixing toned images to substrates.

It is yet another object of the present invention to provide processes for permanently affixing toned images to substrates that enable improved color quality.

It is still another object of the present invention to provide processes for permanently affixing toned images to substrates that enable possible elimination of a conventional fusing step in the imaging process.

Another object of the present invention is to provide processes for permanently affixing toned images to substrates that enable improved smoothness of the imaged substrate's surface.

Yet another object of the present invention is to provide processes for permanently affixing toned images to substrates that enable production of high quality transparencies with monochrome black or colored images thereon.

Still another object of the present invention is to provide processes for permanently affixing toned images to substrates that enable production of high quality transparencies with multi-colored images thereon.

These and other objects of the present invention (or specific embodiments thereof) can be achieved by providing a process for forming images which comprises generating an electrostatic image on an imaging member, developing the electrostatic image with a toner, optionally transferring the developed toner image from the imaging member to a substrate, applying to the developed toner image a curable liquid in which the toner is at least partially soluble, and curing the liquid to a solid.

DETAILED DESCRIPTION OF THE INVENTION

The process of the present invention can employ any means for generating and developing the latent electrostatic image. For example, electrophotographic processes can be employed, wherein an image is formed on an imaging member by exposure of a photosensitive imaging member to light in an imagewise pattern. In addition, the image can be generated by ionographic processes, wherein the image is formed on a dielectric imaging member by applying a charge pattern to the imaging member in imagewise fashion. Further, electrographic processes wherein the image is generated directly on the substrate (such as dielectric paper) and subsequently developed, with no transfer step, can also be employed.

Any suitable developing processes and materials can be employed with the present invention. For example, dry development processes can be employed, either single component development processes in which the developer material consists essentially of toner particles, or two component development processes, wherein the developer material comprises toner particles and carrier particles. Examples of suitable dry toner and developer compositions are well known, as disclosed in, for example, U.S. Pat. No. 5,128,091, U.S. Pat. No. 2,788,288, U.S. Pat. No. 3,079,342, and U.S. Pat. No. 25,136, the disclosures of each of which are totally incorporated herein by reference. Liquid electrophotographic toners can also be employed, provided that the liquid carrier of the toner is substantially completely evaporated or otherwise removed from the image prior to application of the curable liquid to the image.

Any suitable conventional electrophotographic development technique can be utilized to deposit toner particles on the electrostatic latent image on the imaging member. Well known electrophotographic development techniques include magnetic brush development, cascade development, powder cloud development, electrophoretic development, and the like. Magnetic brush development is more fully described in, for example, U.S. Pat. No. 2,791,949, the disclosure of which is totally incorporated herein by reference; cascade development is more fully described in, for example, U.S. Pat. No. 2,618,551 and U.S. Pat. No. 2,618,552, the disclosures of each of which are totally incorporated herein by reference; powder cloud development is more fully described in, for example, U.S. Pat. No. 2,725,305, U.S. Pat. No. 2,918,910, and U.S. Pat. No. 3,015,305, the disclosures of each of which are totally incorporated herein by reference; and liquid development is more fully described in, for example, U.S. Pat. No. 3,084,043, the disclosure of which is totally incorporated herein by reference.

When it is desired to transfer the developed toner image from the imaging member to a substrate, transfer can be effected by any suitable means, such as corona transfer, adhesive transfer, pressure transfer, bias roll transfer, and the like. Preferably, prior to transfer the developed image on the intermediate is charged by, for example, exposure to a corotron to ensure that all of the toner particles are charged to the same polarity, thereby enhancing transfer efficiency by eliminating any wrong-sign toner. Wrong-sign toner particles are particles that have become charged to a polarity opposite to that of the majority of the toner particles and the same as the polarity of the latent image. Wrong-sign toner particles typically are difficult to transfer to a substrate. Examples of substrates include paper, transparency material such as polyester, polycarbonate, or the like, cloth, wood, colored plastic, or any other desired material upon which the finished image will be situated. Although generally not required with the process of the present invention, if desired, the transferred developed image can thereafter be fused or partially fused to the substrate by conventional means. Typical, well known electrophotographic fusing techniques include heated roll fusing, flash fusing, oven fusing, laminating, vapor fusing, adhesive spray fixing, and the like. Alternatively, the curable liquid can be used to stabilize the image partially before any transfer step by applying the curable liquid to the image and curing it only partially, generally by underexposing it to activating radiation, or not curing it all and allowing the natural adhesiveness of the liquid to help hold the toner particles together. The curable liquid can be applied to the image on the imaging member or any intermediate, imagewise or not, or it can be applied as a coating on an intermediate or substrate before receiving the transferred image.

The curable liquid can be applied in any suitable manner. For example, at any step of the process that the curable liquid is to be applied, it can be applied either across the entire substrate or imagewise either precisely or generally. When the curable liquid is applied substantially across the entire substrate, the applicator member can be any suitable means, such as a roll, a belt, a spray, or the like. When the applicator is a roll, the roll can be either smooth or patterned as in a gravure applicator roll. The curable liquid can be applied to the applicator roll from a porous roll containing the curable liquid, or by touching the applicator roll to a pool of the curable liquid, or by a sequence of rolls as is common in the printing industry, or the like. The film thickness on the roll can be controlled with a doctor blade, metering roll, air knife, or the like. When the applicator is a belt, the belt can be either smooth or porous. When the belt is smooth, the curable liquid can be applied to the belt by any of the methods appropriate for a roll. When the belt is porous, the curable liquid can be applied to the belt in sufficient quantity to keep the surface saturated or nearly saturated with curable liquid. With a porous applicator belt, the curable liquid need not to be delivered to the belt uniformly, since the curable liquid will tend to distribute itself uniformly naturally by capillary flow. When the applicator is a spray of curable liquid, the spray can be formed by atomization by pressurized air or other gaseous propellant, or it can be formed by the various ink jet technologies, including continuous stream or drop-on-demand, or the like. The spray can be applied with a member approximately as wide as the substrate, or by an application member or members of lesser width which traverse the substrate and apply the curable liquid. When the curable liquid is to be applied imagewise so as to minimize any excess quantity of curable liquid on the substrate, it can be applied at different levels of resolution; the curable liquid can be applied at the resolution of the toner particles, or it can be applied at the resolution of the distinct parts of the image, or it can be applied at a little less resolution than the distinct parts of the image, allowing for some overlap of the curable liquid into nonimage areas of the substrate. The imagewise formation of the curable liquid at any resolution can be on an intermediate, or on the substrate before transfer of the image so that the curable liquid is underneath the image, or it can be on the image as it is held on an intermediate, or on the substrate so that it is on top of the image, or any combination thereof.

When the curable liquid is to be applied imagewise to a receiver, substrate, or image, it can be applied by any suitable means, such as by glancing contact, or by electrostatic assisted contact, or by direct application by spray, either from an atomized stream or ink jet, or the like. When the imagewise application of the curable liquid is by glancing contact, the image can be passed through a gap with the curable liquid on one side such that the curable liquid makes contact with the toner pile constituting the image, but not with the substrate on which the image is contained. The gap preferably is made with synchronous parts so that the toner pile experiences no shear as it passes through the gap. Capillary action will assist the pick-up of the liquid into the toner pile. When the imagewise application of the curable liquid is by electrostatic assisted contact, either the image or the curable liquid or both are electrostatically charged so that they attract each other. In this instance, the curable liquid has a conductivity sufficient to enable electrostatic assisted contact, preferably exhibiting resistivity values of from about $10^8$ to about $10^{11}$ ohm-cm, and more preferably from about $2\times10^9$ to about $10^{10}$ ohm-cm. The curable liquid can be present in the form of electrostatically charged drops in a spray cloud, or contained in the cells of an electrically biased gravure roll, or the like. When the imagewise application of the curable liquid is from an atomized stream or ink jet, the application of the drops from the spray or from the ink jet can be controlled with the same information that formed the image. For example, in a printer, the latent image can be formed by exposing a photoconductor with light, or by applying a ionographic image—both of which processes write imagewise. The same or derivative information can be used to guide the spray or ink jet application so that the curable liquid is applied at the appropriate resolution. In general, the resolution requirements for the imagewise application of the curable liquid are much less severe that the resolution requirements for the image formation, especially in color applications, since the spatial resolution of an image is much less than its component parts. Accordingly, less efficient or slower imaging members for the curable liquid are satisfactory for high speed printing and copying applications.

The quantity of curable liquid applied is sufficient to penetrate and coalesce the toner pile substantially. The necessary amount of liquid varies with the thickness of the unfused toner pile, and typically is from about one tenth of the toner pile thickness to about equal thickness with the toner pile, and preferably from about 20 to about 60 percent of the toner pile thickness, although greater amounts may be required for the greatest coalescence and adhesion of the toner pile to the substrate. The thickness values of the curable liquid layer are those that are measured before any significant evaporation or absorption of the liquid into the substrate, imaging member, or intermediate occurs.

Provision can be made for cleaning any applicator member, such as a roll or belt. The cleaning can be by any suitable means, such as a wiper blade, or even by curing the excess liquid provided that the cured layer does not adhere strongly to the applicator member and that the cured film can be removed easily. Excess material gathered in any cleaning or waste process can be cured to a solid and the solid disposed of as solid waste.

The curable liquid can be applied to the image either synchronously with the imaging process or as a separate asynchronous process. If desired, the curable liquid can be applied after each and every step of a multistep color imaging process to stabilize each image. The curable liquid can be fully cured between each imaging step to maintain the integrity of each image as in dot by dot color, or the curable liquid can be left partially or completely uncured between each imaging step to help coalesce the various colors.

When the curable liquid is applied at more than one step in the printing process, its composition can be varied from application to application to optimize its performance. For example, the intermediate applications of curable liquids can use a curable liquid or curing activation that results in formation of a tacky layer, and the final application of curable liquid can be used to produce a tough, abrasion resistant image which adheres well to the substrate.

Subsequent to application of the curable liquid to the developed image, the curable liquid is cured to a solid. Curing can be by any suitable means, and generally is determined at least in part by the nature of the curable liquid and/or any polymerization initiator contained therein. When a photoinitiator is selected, curing is effected by exposure of the overcoated image to radiation in the wavelength to which the initiator is sensitive, such as ultraviolet light. Examples of suitable ultraviolet lamps include low pressure mercury lamps, medium pressure mercury lamps, high pressure mercury lamps, xenon lamps, mercury xenon lamps, arc lamps, gallium lamps, lasers, and the like. When a thermal initiator is selected, the overcoated image is heated to a temperature at which the initiator can initiate curing of the liquid vehicle and maintained at that temperature for a period sufficient to cure the image. Electron beam curing can be initiated by any suitable electron beam apparatus. Examples include scanned beam apparatuses, in which electrons are generated nearly as a point source and the narrow beam is scanned electromagnetically over the desired area, such as those available from High Voltage Engineering Corporation, Radiation Dynamics, Inc. (a subsidiary of Monsanto Company), Polymer Physik of Germany, or the like, and linear-filament apparatuses or curtain processor apparatuses, in which electrons are emitted from a line-source filament and accelerated perpendicular to the filament in a continuous linear curtain, such as those available from Energy Sciences, Inc. under the trade name Electrocurtain. Ion beam curing can be initiated by any suitable means, such as a corotron.

The curable liquid is selected so that the liquid can be cured to a solid subsequent to application of the liquid to the image and so that the toner is at least partially soluble in the liquid. The toner generally is sufficiently soluble in the curable liquid to form a fluid. The curable liquid generally is selected so that it acts as a plasticizer for the toner. The toner-made-fluid then is able to coalesce to some degree, or to penetrate the substrate (if it is porous) to some degree, or to wet the substrate (if it is non-porous) to some degree. The degree of fluidity and degree of plasticization generally depends on variables such as the concentration of curable liquid in the image, the temperature of the curable liquid and toner mixture, the time scale appropriate for whatever process is to follow, and the time it takes the curable liquid to penetrate the toner pile. In general, it is not necessary to use a curable liquid that is a very good solvent for the toner, since the purpose of the curable liquid is to reduce the viscosity of the image to essentially the same degree that heat fusing reduces the viscosity of the toned image. A liquid in which the toner is not soluble would not change the viscosity of the toner pile if applied to such a toner; the viscosity of the toner pile in such an instance would be essentially that of the dry toner. The general range of viscosities sought are those viscosities equivalent to the toner resin's viscosity above its glass transition temperature. This change in viscosity generally is attainable with any curable liquid that will at least swell the toner polymer phase. Heat or pressure or both, applied by, for example, a roller, can be applied to the toner pile containing curable liquid to increase the rate of flow and coalescence. Typically, desired viscosity values for the toner pile subsequent to addition of the curable liquid are at least about $1\times10^3$ poise, preferably from about $1\times10^3$ to about $1\times10^5$ poise, and more preferably from about $4.5\times10^3$ to about $7.5\times10^4$ poise, although the viscosity can have other values. Preferably, the toner pile has a viscosity of no less than about 5 centipoise; lower viscosities which approach that of water may cause the toner pile to run, thereby decreasing image quality.

Preferably, the curable liquid also meets other desirable criteria, such as meeting health, safety, and/or environmental requirements, low volatility, a range of toner solubilities so that the extent of dissolution of the toner particles prior to curing can be controlled by selecting a curable liquid with the appropriate toner solubility, and a range of viscosities so that the extent of liquid penetration into the toner pile and substrate fibers can be controlled by selecting a curable liquid of the appropriate viscosity. The curable liquid preferably exhibits little or substantially no volatility at the temperature at which they are applied to the image, imaging member, substrate, intermediate, or the like; low volatility liquids are preferred, since it generally would be undesirable for more than about 10 percent of the curable liquid applied during the process of the present invention to evaporate prior to curing. The viscosity of the curable liquid is selected so that it is appropriate for the method of applying the liquid during the process. For example, if the curable liquid is applied by an ink jet process, the viscosity of the liquid preferably is no more than about 25 centipoise. If the curable liquid is applied by a gravure roller, the viscosity of the liquid preferably is from about 25 to about 500 centipoise, and more preferably from about 30 to about 300 centipoise.

Examples of suitable curable liquids include ethylenically unsaturated compounds, including monomers, dimers, or oligomers having one or more ethylenically unsaturated groups such as vinyl or allyl groups, and polymers having terminal or pendant ethylenic unsaturation. Examples of curable liquids suitable for present invention include, but are not limited to, acrylate and methacrylate monomers or polymers containing acrylic or methacrylic group(s) of the general structure

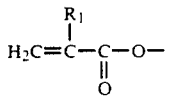

wherein $R_1$ is H or $CH_3$. The active group can be attached to an aliphatic or aromatic group with from 1 to about 20 carbon atoms and preferably from about 8 to about 12 carbon atoms, to an aliphatic or aromatic siloxane chain or ring with from 1 to about 20 dimethyl siloxane units, to a combination of the aforementioned groups, or to a polymer chain. Examples of such compounds include n-dodecyl acrylate, n-lauryl acrylate, methacryloxypropylpenta-methyldisiloxane, methylbis(trimethylsioxy)silylpropylgylcerolmethacrylate, bis(methacryloxybutyl)tetramethyldisiloxane, 2-phenoxyethyl acrylate, polyethylene glycol diacrylate, ethyoxylated bisphenol A diacrylate, pentaerythritol triacrylate, poly(acryloxypropylmethyl)siloxane, methacrylate terminated polystyrene, polybutyldiene diacrylate, and the like. Further examples of liquids believed to be suitable for the present invention include acrylic and methacrylic esters of polyhydric alcohols such as trimethylolpropane, pentaerythritol, and the like, and acrylate or methacrylate terminated epoxy resins, acrylate or methacrylate terminated polyesters, and the like. Another polymerizable material is the reaction product of epoxidized soy bean oil and acrylic or methacrylic acid as described in U.S. Pat. No. 4,215,167, the disclosure of which is totally incorporated herein by reference, as well as the urethane and amine derivatives described therein. Additional examples of radiation curable substances include acrylate prepolymers derived from the partial reaction of pentaerythritol with acrylic acid or acrylic acid esters, including those available from Richardson Company, Melrose Park, Ill. Further, isocyanate modified acrylate, methacrylate and itaconic acid esters of polyhydric alcohols as disclosed in U.S. Pat. No. 3,783,151, U.S. Pat. No. 3,759,809, and U.S. Pat. No. 3,825,479, the disclosures of each of which are totally incorporated herein by reference are believed to be suitable. Radiation curable compositions based on these isocyanate modified esters including reactive diluents such as tetraethylene glycol diacrylate as well as photoinitiators such as chlorinated resins, chlorinated paraffins, and amine photoinitiation synergists are commercially available from Sun Chemical Corporation under the trade name of Suncure. Also believed to be suitable are mixtures of pentaerythritol acrylate and halogenated aromatic, alicyclic, or aliphatic photoinitiators as described in U.S. Pat. No. 3,661,614, the disclosure of which is totally incorporated herein by reference, as well as other halogenated resins that can be crosslinked by ultraviolet radiation. Additionally, materials believed to be suitable are disclosed in U.S. Pat. No. 4,399,209, the disclosure of which is totally incorporated herein by reference.

Also suitable are epoxy monomers or epoxy containing polymers having one or a plurality of epoxy functional groups, such as those resins which result from the reaction of bisphenol A (4,4'-isopropylidenediphenol) and epichlorohydrin, or by the reaction of low molecular weight phenolformaldehyde resins (Novolak resins) with epichlorohydrin, alone or in combination with an epoxy containing compound as a reactive diluent. Reactive diluents such as phenyl glycidyl ether, 4-vinylcyclohexene dioxide, limonene dioxide, 1,2-cyclohexane oxide, glycidyl acrylate, glycidyl methacrylate, styrene oxide, allyl glycidyl ether, and the like may be used as viscosity modifying agents. In addition, the range of these compounds can be extended to include polymeric materials containing terminal or pendant epoxy groups. Examples of these compounds are vinyl copolymers containing glycidyl acrylate or methacrylate as one of the comonomers. Other classes of epoxy containing polymers amenable to cure using the initiators of the present invention are epoxy-polyurethanes, epoxypolyesters, and epoxy-siloxane resins such as those described in *Encyclopedia of Polymer Science and Technology*, 2nd edition, Wiley Interscience, New York, pages 322 to 382 (1986), *Methoden Der Organischen Chemie*, Vol. E20 part 3, Georg Thiame Verlag Stuttgart, New York, pages 1891 to 1994 (1987), Crivello, J. V. et al., *Journal of Polymer Science Part A: Polymer Chemistry*, 1990, 28, pages 479 to 503, and in Crivello, J.V. et al., *Chemistry of Materials*, 1989, 1, pages 445 to 451, the disclosures of each of which are totally incorporated herein by reference, epoxidized natural oils, such as epoxidized soybean oil, epoxidized linseed oil, epoxidized safflower oil, epoxidized corn oil, epoxidized cottoneed oil, epoxidized peanut oil, and the like, and epoxidized alkyl esters of oleic tall oil fatty acids (epoxytallates or epoxytofates). Further examples of suitable epoxy resins are described in *Encyclopedia of Polymer Science and Technology*, 2nd edition, Wiley Interscience, New York, pages 322 to 382 (1986) and in *Methoden Der Organischen Chemie*, Vol. E20 part 3, Georg Thiame Verlag Stuttgart, New York, pages 1891 to 1994 (1987), the disclosures of each of which are totally incorporated herein by reference.

Further examples of suitable curable materials include vinyl ether monomers, oligomers, or polymers containing vinyl ether groups of the general formula $$CHR_1{=}CR_2{-}O{-}$$

where $R_1$ and $R_2$ are hydrogen or alkyl groups with from 1 to about 10 carbon atoms, and preferably from 1 to 2 carbon atoms. Examples of such materials include decyl vinyl ether, dodecyl vinyl ether, hexadecyl vinyl ether, 4-chlorobutylvinyl ether, cyclohexyl vinyl ether, 1,4-cyclohexane dimethanol divinyl ether, diethylene glycol divinyl ether, butanediol divinyl ether, hexanediol divinyl ether, octanediol divinyl ether, decanediol divinyl ether. Further examples of vinyl ether monomers and polymers are shown in "Synthesis, Characterization, and Properties of Novel Aromatic Bispropenyl Ether" by J. V. Crivello and D. A. Conlon, *Journal of Polymer Science: Polymer Chemistry Edition*, Vol. 22, 2105-2121 (1984), "Aromatic Bisvinyl Ethers: A New Class of Highly Reactive Thermosetting Monomers" by J. V. Crivello and D. A. Conlon, *Journal of Polymer Science: Polymer Chemistry Edition*, Vol. 21, 1785-1799 (1983), "Vinyloxy-Functional Organopolysiloxane Compositions," by J. V. Crivello and R. P. Eckberg, U.S. Pat. No. 4,617,238, "Carbocationic Polymerization of Vinyl Ethers" by T. Higashimura, M. Sawamoto in *Comprehensive Polymer Science*, Vol. (3), pages 673 to 696, Pergamon Press (1989), "Polymerisation von Vinylethern" by J. Reiners in *Methoden Der Organischen Chemie*, Vol. E20 part 2, Georg Thiame Verlag Stuttgart, New York, pages 1071-1115 (1987), the disclosures of each of which are totally incorporated herein by reference. Cyclic vinyl ethers with the following basic structure

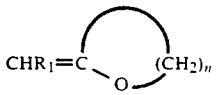

wherein $R_1$ is hydrogen or an alkyl group with from 1 to about 20 carbon atoms, and preferably from 1 to about 4 carbon atoms, and n=2 to about 20 and preferably from 3 to 8, are also useful, such as 4-phenyl-2-methylenetetrahydrofuran, 2-methylene-3,4-benzotetrahydrofuran, 2,2'-diphenyl-4-methylene-1,3-dioxolane, 2-methyl-2-phenyl-4-methylene-1,3-dioxolane and the like. Further examples can be found in "Ring-Opening Polymerization" by W. J. Bailey in *Comprehensive Polymer Science*, Vol. (3), pages 283 to 320, Pergamon Press (1989), the disclosure of which is totally incorporated herein by reference.

One preferred curable liquid comprises a mixture of an epoxy siloxane and a vinyl ether. Both of these materials can be cured easily upon exposure to ultraviolet radiation. In addition, both classes of materials can be cured with the same initiators and are mutually miscible. The epoxy siloxanes typically constitute the major portion of the mixture, and have very low volatility, are safe to use, and are usually not solvents for the polymers commonly used in toners and developers. The vinyl ether typically are good solvents for many polymers commonly used in toners and developers.

Also suitable are styrene and indene monomers or oligomers, and polymers containing styrenic or indenic groups of the general formula

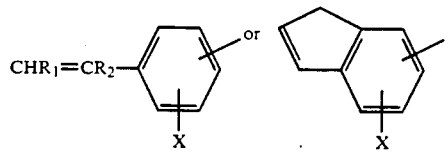

where $R_1$ and $R_2$ are H, alkyl, or aromatic groups, X is an electron donating group such as alkyl, alkoxy, N,N-dialkylamine groups and the like. The styrenic and indenic groups shown above can be attached to a polymer chain. Examples of such materials include butyl-styrene, p-ethoxy styrene, p-butoxy styrene, p-octoxy styrene, o-allyloxystyrene, divinyl benzene, 1,4-bis(p-vinylbenzeneoxy) butane, 1,8-bis(p-vinylbenzeneoxy)octane, and the like. Further examples of styrene and indene monomers are disclosed in *Vinyl and Related Polymers*, by C. E. Schildknecht, Wiley and Sons, 1952, chapters 1, 2, and 3, and *Cationic Polymerization of Olefins: A Critical Inventory*, by J. P. Kennedy, Wiley and Sons, 1975, pages 228-330, the disclosures of each of which are totally incorporated herein by reference.

Also suitable are natural occurring unsaturated oils such as linseed oil, tung oil, oiticica oil, castor oil, fish oils, soybean oil, coconut oil, cottonseed oil, and the like. Natural occurring unsaturated resins are also suitable, such as manila resin, dammar resins, Congo and Kauri resins, Ester gum (glyceryl ester of rosin), phenolic resins, and the like. Further examples of naturally occuring materials of this type are disclosed in, for example, "Encyclopedia of Polymer Science and Engineering," "Coatings" volume 3, pages 615 to 675, by J. H. Lowell (1985), "Drying Oil" volume 5, pages 203 to 214, by Z. W. Wicks, Jr. (1986), and "Polymers from Renewable Sources" volume 12, pages 678 to 682, by L. H. Sperling and C. E. Carraher (1988) (Wiley & Sons), the disclosures of each of which are totally incorporated herein by reference.

In addition, vinyl acetal and ketene acetal monomers of the general formulae are suitable

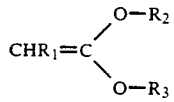

(I)

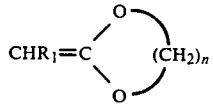

(II)

wherein $R_1$ is hydrogen or alkyl or aromatic groups with from 1 to about 20 carbon atoms, and preferably from 1 to about 6 carbon atoms, and $R_2$ and $R_3$ are alkyl or aromatic groups with from 1 to about 20 carbon atoms, and preferably from 1 to about 6 carbon atoms, n=2 to 20 and preferably from 3 to 8 as in the case of cyclic vinyl acetal (II). Typical examples include diethyl ketene acetal, di-butyl ketene acetal, diphenyl ketene acetal, 2-methylene-1,3-dioxepane, 4-phenyl-2-methylene-1,3-dioxepane, 4,6-dimethyl-2-methylene-1,3-dioxane, 2-methylene-1,3-dioxe-5-pene, 4-vinyl-2-methylene-1,3-dioxzlane, and the like. Further examples are disclosed in "Ring-Opening Polymerization" by W. J. Bailey in *Comprehensive Polymer Science*, Vol. 3, pages 283 to 320, Pergamon Press (1989), the disclosure of which is totally incorporated herein by reference.

Further, linear or branched aliphatic α-olefins, such as 1-dodecene, 5-methyl-1-heptene, 2,5-dimethyl-1,5-hexadiene, and the like, alicyclic olefins and diolefins, such as d-limonene, 1,4-dimethylenecyclohexane, 1-methylene-4-vinylcyclohexane, and the like, conjugated polyenes, such as 2-phenyl-1,3-butadiene, myrcene, allocimene, 1-vinylcyclohexene, ethylbenzofulvene, and the like, bicyclic olefins, such as α-pinene, β-pinene, 2-methylene-norbornane, and the like are all suitable carrier liquids. Further examples of these classes of olefins are disclosed in *Cationic Polymerization of Olefins: A Critical Inventory*, by J. P. Kennedy, Wiley and Sons, pages 1 to 228 (1975), the disclosure of which is totally incorporated herein by reference.

Liquid 1,2-polybutadiene resins and 1,4-polybutadiene resins of the formulae

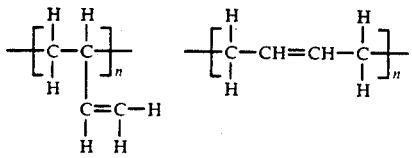

with a molecular weight between about 200 and about 3000, and preferably between about 200 and 1000, are also suitable. A thiol compound is generally present as the comonomers with the olefin monomers. Typical examples include trithiol trimethylolethane tris(β-mercaptopropionate), tetrathiol pentaerythritol tetrakis(thiogylcolate), dimonene dimercaptane, and the like.

Other curable materials include those that contain moieties such as cinnamic groups of the formula

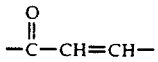

fumaric or maleic groups of the formula

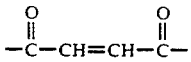

or maleimido groups of the formula

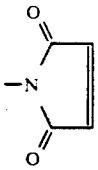

These functional groups can be present within either a monomer of a polymer comprising the liquid.

Specific examples include citrial, cinnamyl acetate, cinnamaldehyde, 4-vinylphenyl cinnamates, 4-vinylphenyl, 4-nitrocinnamate, 4-isopropenylphenyl cinnamate, poly[1-(cinnamoyloxymethylphenyl)ethylene], poly[1-(cinnamoyloxymethylphenyl)ethylene-co-1-[(4-nitrophenoxy)methylphenyl]ethylene], 3-(2-furyl)acrolein), fumaric acid diethylester, fumaric acid dihexyl ester, maleic acid dibutylester, maleic acid diphenyl ester, N-phenyl maleinide, N-(4-butylphenyl) maleimide, m-phenylenediamine bis(maleimide), and N,N'-1,3phenylenedimaleimide, and polyfunctional maleimide polymer MP-2000 from Kennedy and Klim, Little Silver, N.J.

In addition, monomers, dimers, or oligomers containing a multiplicity of one or more suitable functional groups can also be employed as the curable liquid.

Optionally, the curable liquid can contain a crosslinking agent. Crosslinking agents generally are monomers, dimers, or oligomers containing a multiplicity of functional groups, such as two styrene functionalities, a styrene functionality and an acrylate functionality, or the like. The curable liquid can consist entirely of these multifunctional monomers, dimers, or oligomers, can contain no crosslinking agent at all, and can contain both monofunctional monomers, dimers, or oligomers and multifunctional monomers or oligomers. Generally, the presence of a crosslinking agent is preferred to provide improved film forming characteristic, faster curing, and improved adhesion of the cured image to the substrate. When present, the crosslinking agent is present in an effective amount, typically from about 1 to about 100 percent by weight of the curable liquid and preferably from about 10 to about 50 percent by weight of the curable liquid.

Additional examples of curable liquids include those materials disclosed in, for example, U.S. Pat. No. 3,989,644, U.S. Pat. No. 4,264,703, U.S. Pat. No. 4,840,977, and U.S. Pat. No. 4,933,377, the disclosures of each of which are totally incorporated herein by reference.

Optionally, the curable liquid can contain a crosslinking agent. Crosslinking agents generally are monomers, dimers, or oligomers containing a multiplicity of functional groups, such as two styrene functionalities, a styrene functionality and an acrylate functionality, or the like. The curable liquid can consist entirely of these multifunctional monomers, dimers, or oligomers, can contain no crosslinking agent at all, and can contain both monofunctional monomers, dimers, or oligomers and multifunctional monomers or oligomers. Generally, the presence of a crosslinking agent is preferred to provide improved film forming characteristics, faster curing, and improved adhesion of the cured image to the substrate. When present, the crosslinking agent is present in any effective amount, typically from about 1 to about 100 percent by weight of the curable liquid and preferably from about 10 to about 50 percent by weight of the curable liquid, although the amount can be outside of these ranges.

The curable liquid employed in the process of the present invention can also contain an initiator to initiate curing of the liquid. The initiator can be added before or after application of the liquid to the image. Any suitable initiator can be employed provided that the objectives of the present invention are achieved; examples of the types of initiators suitable include thermal initiators, radiation sensitive initiators such as ultraviolet initiators, infrared initiators, visible light initiators, or the like, initiators sensitive to electron beam radiation, ion beam radiation, gamma radiation, or the like. In addition, combinations of initiators from one or more class of initiators can be employed. Radical photoinitiators and radical thermal initiators are well known, as is electron beam curing; these materials and processes are disclosed in, for example, "Radiation Curing of Coatings," G. A. Senich and R. E. Florin, *Journal of Macromolecular Science Review. Macromol. Chem. Phys.*, C24(2), 239–324 (1984), the disclosure of which is totally incorporated herein by reference. Examples of initiators include those that generate radicals by direct photofragmentation, including benzoin ethers such as benzoin isobutyl ether, benzoin isopropyl ether, benzoin methyl ether and the like, acetophenone derivatives such as 2,2-dimethoxy-2-phenylacetophenone, dimethoxyacetophenone, 4-(2-hydroxyethoxy)phenyl-(2-propyl)ketone, 2-hydroxy-2-methyl-1-phenylpropan-1-one, 2,2,2-trichloroacetophenone, 2,4,6-trimethylbenzoyldiphenylphospine oxide, and the like; initiators that form radicals by bimolecular hydrogen transfer, such as the photoexcited triplet state of diphenyl ketone or benzophenone, diphenoxybenzophenone, bis(N,N-dimethylphenyl) ketone or Michler's ketone, anthraquinone, 4-(2-acryloyl-oxyethyoxy)-phenyl-2-hydroxy-2-propylketone and other similar aromatic carbonyl compounds, and the like; initiators that form radicals by electron transfer or via a donor-acceptor complex, also known as an exciplex, such as methyldiethanolamine and other tertiary amines; photosensitizers used in combination with a radical generating initiator, wherein the sensitizer absorbs light energy and transfers it to the initiator, such as a combination of a thioxanthone sensitizer and a quinoline sulfonyl chloride initiator and similar combinations; cationic initiators that photolyze to strong Lewis acids, such as aryldiazonium salts of the general formula $Ar—N_2^+X^-$ wherein Ar is an aromatic ring such as butyl benzene, nitrobenzene, dinitrobenzene, or the like and X is $BF_4$, $PF_6$, $AsF_6$, $SbF_6$, $CF_3SO_3$, or the like, diaryliodonium salts of the general formula $Ar_2I^-X^-$, wherein Ar is an aromatic ring such as methoxy benzene, butyl benzene, butoxy benzene, octyl benzene, didecyl benzene, or the like, and X is an ion of low nucleophilicity, such as $PF_6$, $AsF_6$, $BF_4$, $SbF_6$, $CF_3SO_3$, and the like; triarylsulfonium salts of the general formula $Ar_3S^+X^-$, wherein Ar is an aromatic ring such as hydroxy benzene, methoxy benzene, butyl benzene, butoxy benzene, octyl benzene, dodecyl benzene, or the like and X is an ion of low nucleophilicity, such as $PF_6$, $AsF_6$, $SbF_6$, $BF_4.CF_3SO_3$, or the like; nonradical initiators comprising amine salts of alpha-ketocarboxylic acids, such as the tributyl ammonium salt of phenylglyoxylic acid; and the like, as well as mixtures thereof. Further photoacid generating initiators are disclosed in "The Chemistry of Photoacid Generating Compounds," by J. V. Crivello in *Proceedings of the ACS Division of Polymeric Materials: Science and Engineering*, Vol. 61, pages 62–66, (1989), "Redox Cationic Polymerization: The Diaryliodonium Salt/Ascorbate Redox Couple," by J. V. Crivello and J. H. W. Lam in *Journal of Polymer Science: Polymer Chemistry Edition*, Vol. 19, pages 539–548 (1981), "Redox-Induced Cationic Polymerization: The Diaryliodonium Salt-/Benzoin Redox Couple," by J. V. Crivello and J. L. Lee in *Journal of Polymer Science: Polymer Chemistry Edition*, Vol. 21, pages 1097–1110 (1983), "Diaryliodonium Salts as Thermal Initiators of Cationic Polymerization," by J. V. Crivello, T. P. Lockhart and J. L. Lee in *Journal of Polymer Science: Polymer Chemistry Edition*, Vol. 21, pages 97–109 (1983), the disclosures of each of which are totally incorporated herein by reference.

Additional examples of suitable initiators include carbon containing cations capable of initiating cationic polymerication, with a non-nucleophilic counterion which is an at least partially fluorinated hydrocarbylsulfonato metallate, such as perfluoroethylsulfonatoaluminate, as disclosed in, for example, U.S. Pat. No. 5,084,586 and U.S. Pat. No. 5,124,417, the disclosures of each of which are totally incorporated herein by reference.

Further examples of suitable initiators include alpha-alkoxy phenyl ketones, O-acylated alpha-oximinoketones, polycyclic quinones, xanthones, thioxanthones, halogenated compounds such as chlorosulfonyl and chloromethyl polynuclear aromatic compounds, chlorosulfonyl and chloromethyl heterocyclic compounds, chlorosulfonyl and chloromethyl benzophenones and fluorenones, haloalkanes, alpha-halo alphaphenylacetophenones, photoreducible dye-reducing agent redox couples, halogenated paraffins such as brominated or chlorinated paraffin, benzoin alkyl esters, cationic diborate anion complexes, anionic di-iodonium ion compounds, and anionic dye-pyrrilium compounds.

Additional examples of suitable initiators are disclosed in, for example, U.S. Pat. No. 4,683,317, U.S. Pat. No. 4,378,277, U.S. Pat. No. 4,279,717, U.S. Pat. No. 4,680,368, U.S. Pat. No. 4,443,495, U.S. Pat. No. 4,751,102, U.S. Pat. No. 4,334,970, "Complex Triarylsulfonium Salt Photoinitiators I. The Identification, Characterization, and Syntheses of a New Class of Triarylsulfonium Salt Photoinitiators," J. V. Crivello and J. H. W. Lam, *Journal of Polymer Science: Polymer Chemistry Edition*, Vol. 18, 2677–2695 (1980); "Complex Triarylsulfonium Photoinitiators II. The Preparation of Several New Complex Triarylsulfonium salts and the Influence of Their Structure in Photoinitiated Cationic Polymerization," J. V. Crivello and J. H. W. Lam, *Journal of Polymer Science Polymer Chemistry Edition*, Vol. 18, pages 2697–2714 (1980); "Diaryliodonium Salts A New Class of Photoinitiators for Cationic Polymerization," J. V. Crivello and J. H. W. Lam, *Maromolecules*, Vol. 10, pages 1307–1315 (1977); and "Developments in the Design and Applications of Novel Thermal and Photochemical Initiators for Cationic Polymerization" by J. V. Crivello, J. L. Lee and D. A. Conlon in *Makromol. Chem. Macromolecular Symposium*, Vol. 13/14, pages 134–160 (1988), the disclosures of each of which are totally incorporated herein by reference. Particularly preferred are the diaryl iodonium salts and their derivatives, the triaryl sulfonium salts and their derivatives, and the triphenyl phosphonium salts and their derivatives, with examples of derivatives being those with alkyl, aryl, or alkoxy substituents on the aryl rings. The initiator is present in the curable liquid in any effective amount, generally from about 0.1 to about 10 percent by weight of the liquid, and preferably from about 0.1 to about 3 percent by weight of the liquid, although the amount can be outside of these ranges.

When a photoinitiator is selected, photopolymerization can be performed with the aid of an autoxidizer, which is generally a compound capable of consuming oxygen in a free radical chain process. Examples of useful autoxidizers include N,N-dialkylaninines, particularly those substituted in one or more of the ortho, meta, or para positions with groups such as methyl, ethyl, isopropyl, t-butyl, 3,4-tetramethylene, phenyl, trifluoromethyl, acetyl, ethoxycarbonyl, carboxy, carboxylate, trimethylsilylmethyl, trimethylsilyl, triethylsilyl, trimethylgermanyl, triethylgermanyl, trimethylstannyl, triethylstannyl, n-butoxy, n-pentyloxy, phenoxy, hydroxy, acetyl-oxy, methylthio, ethylthio, isopropylthio, thio(mercapto-), acetylthio, fluoro, chloro, bromo, or iodo. Autoxidizers when present are present in any effective amount, typically from about 0.1 to about 5 percent by weight, of the curable liquid, although the amount can be outside of this range.

A UV sensitizer which could impart electron transfer, and exciplex-induced bond cleavage processes during radiation curing can, if desired, be included in the curable liquid employed in the process of the present invention. Typical photosensitizers include anthrecene, perylene, phenothizine, thioxanthone, benzophenone, fluorenone, and the like. The sensitizer is present in any effective amount, typically from about 0.1 to about 5 percent by weight, of the curable liquid, although the amount can be outside this range.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A multi-colored yellow, cyan, and magenta original was copied twice with a Xerox ® 1005 color copier by exposing the original to the imaging member, developing with yellow, cyan, and magenta toners, and transferring the developed multi-colored image to Xerox ® 3R2780 transparency sheets. The transparencies were removed from the 1005 ® copier prior to fusing, so that the images on the transparencies consisted of unfused toner piles. One transparency sheet was left uncoated. The other transparency sheet was overcoated with a curable liquid comprising a solution of 20 parts by weight cyclohexyldivinyl ether (Rapi-Cure CHVE, obtained from GAF Corp., Wayne, N.J.) and 80 parts by weight epoxy siloxane (UV9300, obtained from General Electric, Waterford, N.Y.) to which had been added one part by weight of an ultraviolet initiator (UV9310C, obtained from General Electric, Waterford, N.Y.). The liquid was applied to the surface of the transparency sheet by a 0.005 inch Bird applicator (Gardner Laboratory, Silver Spring, Md.). Subsequently, the coated transparency sheet was placed in a ultraviolet oven (Hanovia UV Laboratory System, Hanovia, Newark, N.J.) at 300 Watts per inch power at a speed of 100 feet per minute to cure the curable liquid to a solid. The curable liquid coating on the toner particles rendered the toner fluid to the touch before curing to a solid, but not so fluid that the image lost any noticeable resolution. The wetted image was more stable to handling than the dry toner image. The two transparencies were then placed on an overhead projector. The transparency which had been overcoated with the curable liquid exhibited the same colors in the image projected therefrom as were seen on the transparency itself by reflected light, whereas the transparency which had not been overcoated with the curable liquid projected opaque, black images. The curable liquid coating coalesced the individual toner particles to provide good projection efficiency. A comparison of the overcoated transparency of Example II, wherein the toner image had been fused to the transparency prior to overcoating with the curable liquid, to the overcoated transparency of this Example, wherein the toner image had not been fused to the transparency prior to overcoating with the curable liquid, indicated that the images projected from the overcoated transparency of Example II were slightly superior with respect to color quality. It is believed that color equivalent to that obtained in Example II can be achieved by the process of this Example by varying the ratios of curable liquids and/or by allowing longer times for the curable liquid to penetrate the toner pile.

EXAMPLE II

A multi-colored yellow, cyan, and magenta original was copied twice with a Xerox ® 1005 color copier by exposing the original to the imaging member, developing with yellow, cyan, and magenta toners, and transferring the developed multi-colored image to Xerox ® 3R2780 transparency sheets. The images were fused to the transparency sheets by the fusing system in the 1005 ® machine. One fused transparency sheet was left uncoated. The other fused transparency sheet was overcoated with a curable liquid comprising a solution of 20 parts by weight cyclohexyldivinyl ether (Rapi-Cure CHVE, obtained from GAF Corp., Wayne, N.J.) and 80 parts by weight epoxy siloxane (UV9300, obtained from General Electric, Waterford, N.Y.) to which had been added one part by weight of an ultraviolet initiator (UV9310C, obtained from General Electric, Waterford, N.Y.). The liquid was applied to the surface of the transparency sheet by a 0.005 inch Bird applicator (Gardner Laboratory, Silver Spring, Md.). Subsequently, the coated transparency sheet was placed in a ultraviolet oven (Hanovia UV Laboratory System, Hanovia, Newark, N.J.) at 300 Watts per inch power at a speed of 100 feet per minute to cure the curable liquid to a solid. The curable liquid coating on the toner particles rendered the toner fluid to the touch before curing to a solid, but not so fluid that the image lost any noticeable resolution. The wetted image was more stable to handling than the dry toner image.

The two transparencies thus imaged were then placed on an overhead projector. The transparency which had been overcoated with the curable liquid exhibited significantly improved brightness of color in the image projected therefrom compared to the transparency which had not been overcoated with the curable liquid. The curable liquid coating significantly reduced the number of toner particle interfaces that scatter light by coalescing together the particles.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for forming images which comprises generating an electrostatic image on an imaging member, developing the electrostatic image with a toner, optionally transferring the developed toner image from the imaging member to a substrate, applying to the developed toner image a curable liquid in which the toner is at least partially soluble, and curing the image to a solid.

2. A process according to claim 1 wherein the imaging member is photosensitive and the electrostatic image is generated by an electrophotographic process.

3. A process according to claim 1 wherein the imaging member is a dielectric and the electrostatic image is generated by an ionographic process.

4. A process according to claim 1 wherein the developed image is affixed to the imaging member by application of the curable liquid to the imaging member and curing of the liquid to a solid.

5. A process according to claim 1 wherein the developed image is affixed to the substrate by application of the curable liquid to the image and curing of the liquid to a solid.

6. A process according to claim 1 wherein the curable liquid is applied to the image after the image is affixed to the substrate.

7. A process according to claim 1 wherein the curable image is applied to the image on the imaging member, the curable liquid and the image are transferred to the substrate, and the curable liquid is cured to a solid subsequent to transfer to the substrate.

8. A process according to claim 1 wherein the developed toner image is transferred from the imaging member to an intermediate transfer element, the curable liquid is applied to the image on the intermediate transfer element, the curable liquid and the image are transferred from the intermediate transfer element to the substrate, and the curable liquid is cured to a solid subsequent to transfer to the substrate.

9. A process according to claim 8 wherein the curable liquid is partially cured on the intermediate transfer element prior to transfer to the substrate.

10. A process according to claim 1 wherein the curable liquid is applied to an intermediate transfer element, the developed toner image is transferred from the imaging member to the intermediate transfer element bearing the curable liquid, the curable liquid and the image are transferred from the intermediate transfer element to the substrate, and the curable liquid is cured to a solid subsequent to transfer to the substrate.

11. A process according to claim 10 wherein the curable liquid is partially cured on the intermediate transfer element prior to transfer to the substrate.

12. A process according to claim 1 wherein the curable liquid is applied to the developed image in a layer having a thickness of from about 10 percent to about 100 percent of the toner image thickness.

13. A process according to claim 1 wherein the toner exhibits a solubility in the curable liquid such that subsequent to addition of the curable liquid to the toner image, the image exhibits a viscosity of at least about $1\times10^3$ poise.

14. A process according to claim 1 wherein the toner exhibits a solubility in the curable liquid such that subsequent to addition of the curable liquid to the toner image, the image exhibits a viscosity of from about $1\times10^3$ to about $1\times10^5$ poise.

15. A process according to claim 1 wherein the toner exhibits a solubility in the curable liquid such that subsequent to addition of the curable liquid to the toner image, the image exhibits a viscosity of from about $4.5\times10^3$ to about $7.5\times10^4$ poise.

16. A process according to claim 1 wherein the curable liquid comprises a mixture of an epoxy siloxane and a vinyl ether.

17. A process according to claim 1 wherein the curable liquid contains a polymerization initiator.

* * * * *